US006296808B1

(12) United States Patent
Pearman

(10) Patent No.: US 6,296,808 B1
(45) Date of Patent: Oct. 2, 2001

(54) METHOD AND APPARATUS FOR PROTECTING BUILDING PERSONNEL DURING CHEMICAL OR BIOLOGICAL ATTACK

(75) Inventor: A. Noel J. Pearman, St. Paul, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/281,452

(22) Filed: Mar. 30, 1999

(51) Int. Cl.[7] ..... A62C 37/36

(52) U.S. Cl. ..... 422/62; 134/56 R; 134/105; 134/113; 134/198; 137/68.12; 137/68.13; 137/76; 137/78.1; 169/56; 169/57; 169/60; 169/61

(58) Field of Search ..... 436/55; 422/62; 137/68.12, 68.13, 76, 78.1; 169/56, 57, 60, 61; 134/56 R, 105, 113, 198

(56) References Cited

U.S. PATENT DOCUMENTS

| | | | | |
|---|---|---|---|---|
| 3,129,765 | | 4/1964 | Wait . | |
| 3,713,491 | * | 1/1973 | Grabowski et al. . | |
| 3,730,998 | | 5/1973 | Schmidt et al. | 179/15 BS |
| 3,863,720 | * | 2/1975 | Young . | |
| 4,020,477 | | 4/1977 | Holland | 340/224 |
| 4,095,211 | | 6/1978 | Shaughnessy | 340/224 |
| 4,232,184 | | 11/1980 | Faust | 174/92 |
| 4,232,308 | | 11/1980 | Lee et al. | 340/539 |
| 4,359,097 | * | 11/1982 | Claussen . | |
| 4,511,887 | | 4/1985 | Fiore | 340/539 |
| 4,523,184 | | 6/1985 | Abel | 340/539 |
| 4,575,712 | | 3/1986 | Winick | 340/539 |
| 4,991,658 | | 2/1991 | Shlomo . | |
| 5,074,137 | * | 12/1991 | Harris et al. . | |
| 5,353,879 | * | 10/1994 | Watanabe et al. . | |
| 5,617,922 | | 4/1997 | Sundholm . | |
| 5,648,914 | | 7/1997 | Bauer et al. . | |
| 5,761,206 | | 6/1998 | Kackman | 370/476 |
| 5,808,541 | * | 9/1998 | Golden . | |
| 5,809,013 | | 9/1998 | Kackman | 370/253 |
| 5,828,300 | | 10/1998 | Addy et al. | 340/539 |
| 5,947,207 | * | 9/1999 | Conforti et al. . | |

FOREIGN PATENT DOCUMENTS

| | | | |
|---|---|---|---|
| 2770781A | | 5/1999 | (FR) . |
| 06/000230 | * | 1/1994 | (JP) . |

* cited by examiner

*Primary Examiner*—Jan Judlow
(74) *Attorney, Agent, or Firm*—John G. Shudy, Jr.

(57) ABSTRACT

A system for at least partially decontaminating personnel in response to detection of an agent harmful to human life such as a chemical or biological agent. The system can provide a sprinkler head above a walkway such as a hallway through which personnel are expected to walk. The sprinkler can provide a spray of decontamination fluid such as gas or liquid over personnel passing underneath, removing or neutralizing at least some of the harmful agent and reducing the transport of the agent from one area to another. Preferably, the system includes a sprinkler or shower head coupled to an existing fire isle control sprinkler supply pipe, wherein the sprinkler head may include a valve that is remotely controlled and can be opened in response to detection of a chemical or biological agent.

12 Claims, 2 Drawing Sheets

METHOD AND APPARATUS FOR PROTECTING BUILDING PERSONNEL DURING CHEMICAL OR BIOLOGICAL ATTACK

FIELD OF THE INVENTION

The present invention is generally related to building plumbing. Specifically, the present invention is related to water sprinkler heads or washing stations activated in response to chemical or biological attack for the purpose of decontaminating personnel passing under the sprinkler heads.

BACKGROUND OF THE INVENTION

The recent demise of the cold war and decline in superpower tensions has been accompanied by an increase in concern about the viability of weapons of mass destruction such as chemical and biological (CB) weapons. CB weapons include chemical agents such as phosgene, nerve agents such as Sarin, and biological agents such as anthrax or smallpox. CB weapons may be delivered to occupants within a building by releasing the agents either external to the building or within the building.

In response to such a release of harmful agents, people may be moved into a building, out of a building, or from one part of a building to another, depending on the location of the release and the relative safety of various areas of the building or buildings. In response to such an agent release, it may also be desirable to attempt to wash the harmful agent from people to benefit the contaminated personnel and to lessen the spread of the agent carried by the contaminated personnel. While such decontamination may be desirable, it may not be desirable to generate concern by having an explicit and distinct CB decontamination station placed in a building hallway.

The risk of CB weapons being used may escalate rapidly over a short time period.

Given long-range awareness and time for preparation, particular buildings such as key military sites, can be equipped or designed in advance to deal with this possibility. However, the awareness of the imminent likely use of CB weapons against a building may give only a short time period for preparation. Also, the risk against a particular building may increase in a short time period.

What would be desirable is a system for decontaminating people that is unobtrusive and does not call attention to itself as a decontamination station for CB warfare. What would be desirable is a system for CB decontamination that could be added relatively quickly to existing building utilities while attracting little attention and incurring little expense.

SUMMARY OF THE INVENTION

The present invention includes a system for decontaminating persons in a building using at least one sprinkler head or wash station connected to a source of water or other gaseous or liquid decontamination fluid. One system includes a sprinkler head connected to a water pipe having other temperature-activated sprinkler heads connected. Another system utilizes a sensor for detecting agents harmful to human life such as chemical or biological agents. Yet another system utilizes automatic activation of the sprinkler in response to harmful agent detection, while another, manual system, requires human activation in response to harmful agent detection.

A sprinkler head or shower head can be positioned above a hallway in a building and attached to the water pipe serving the temperature activated fire sprinklers. The decontaminating sprinkler head can have a valve disposed between the head and the pipe, with the valve being opened by a remote activation device in response to detection of an agent harmful to human life such as a chemical or biological agent. In one embodiment, a severing device capable of severing the temperature sensitive element in a conventional fire sprinkler is used. The severing device may include a heating element capable of heating a temperature sensitive element to its melting point, severing the element and opening the sprinkler head to flow. Alternatively, the severing device may include a small explosive charge capable of severing the heat sensitive element. Both severing devices can be positioned around an existing temperature sensitive element in an existing fire control sprinkler in a very short time, while allowing the sprinkler to still function for its intended purpose. In yet another severing device, the original fire sprinkler temperature sensitive element is replaced with an element that is both temperature sensitive and severable upon command from a signal generated in response to detection of a harmful agent. The replacement device may be installed by removing the existing element and replacing it with the new element while the fire system remains active.

Installation can be accomplished in some systems by turning off the existing fire sprinklers, draining any water if present, and cutting in a new sprinkler head. The fire sprinkler line can then be filled with water and reactivated. In other systems, a severing element can be positioned near an existing sprinkler head element. Wires can be run from the newly installed sprinkler head or from the severing device to a device for initiating decontaminating water flow. Wires can be run either centrally to a triggering device or to local receiver in communication with a central triggering device. In some systems, the decontamination system is separate from the fire sprinkler system.

DETAILED DESCRIPTION OF THE INVENTION

Figure 1:
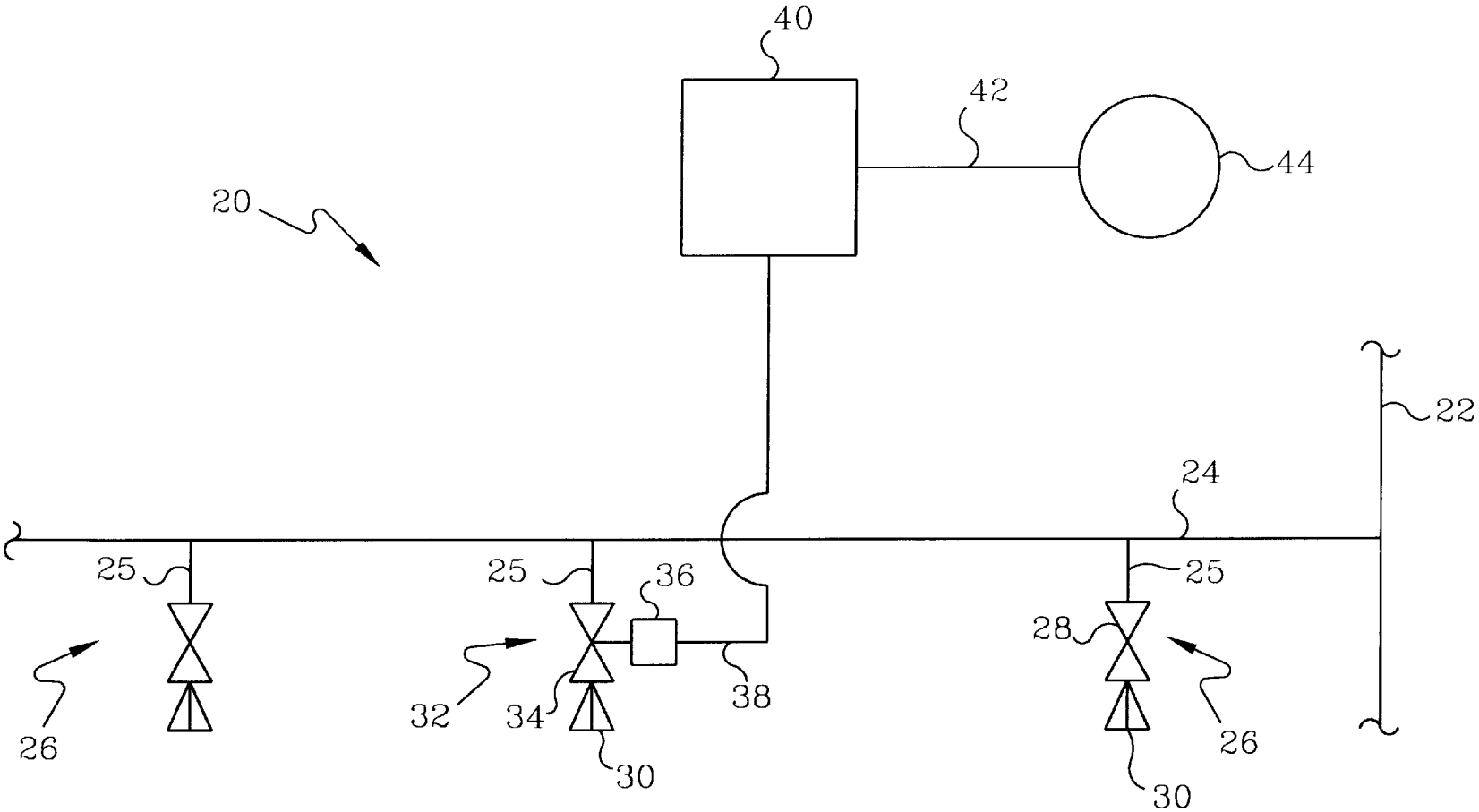
FIG. 1 is a schematic view of a building sprinkler system having both heat-activated sprinkler heads and sprinkler heads activated in response to detection of a CB attack or detection of agents harmful to human life.

FIG. 1 illustrates a fire control sprinkler system 20 having a water main 22, a secondary supply water line 24 branching off the main, and a plurality of nipples 25 branching off secondary line 24. In the embodiment illustrated, secondary line 24 supplies a plurality of conventional sprinkler heads 26 through nipples 25, with each sprinkler head including a temperature-activated valve 28 and a sprayer or diffuser 30 for scattering water over a large area. Temperature-activated valve 28 typically includes an alloy having a composition which melts within a controlled temperature range. A temperature-activated valve is usually an on-off valve which can include a vertically, disposed element having a top half and a bottom half held together by a solder that melt.,; at a relatively precise temperature. The top half may support a valve plug which extend;s into the water line or nipple. When the solder melts, the two halves irreversibly come apart, falling from the sprinkler head, allowing the valve plug to drop from the nipple under the water pressure, allowing water to flow down and over the sprayer or diffuser.

Also shown in FIG. 1 is a remotely-activated sprinkler head 32, also disposed on a nipple 25. Remotely-activated sprinkler head 32 includes a valve 34 and a valve actuator 36. Valve actuator 36 is coupled to a controller 40 through a first communication line 38. Controller 40 is coupled to a Chemical or Biological Detector (CBD) 44 through a second communication line 42. In one embodiment, controller 40 can be operated in either an automatic mode or a manual mode. In automatic mode, detection of a harmful agent by CBD 44 automatically results in valve actuator 36 being activated, thereby opening valve 34 to flow. In manual mode, controller 40 acts as an annunciator and manually operated triggering device which can also act to activate valve actuator 36.

In one embodiment, valve actuator 36 is a conventional solenoid and valve 34 is a solenoid-operated valve. In another embodiment, valve 34 is a conventional temperature sensitive element and actuator 36 is a severing device.

In some systems, additional remotely actuated sprinkler heads are added to an existing fire control sprinkler system. The fire control sprinkler supply line can be shut down, remotely actuated sprinkler heads installed, and the water line turned on again. In some situations, there may not be adequate time to complete the plumbing work: necessary to cut in new sprinkler heads, yet remotely actuated sprinkler heads are still needed. In such a situation, it may be expedient to make existing fire control sprinkler heads remotely actuatable. In such situations, one method includes holding any sprinkler valve plug in place, removing the existing temperature sensitive element, and replacing that element with a remotely actuated element that may also be temperature sensitive to preserve the fire suppression capabilities of the original sprinkler head.

Systems can use a variety of decontamination fluids, both gaseous and liquid. The decontamination fluid used can be varied in response to the particular harmful agent either expected or detected. In some systems, water is used as a decontamination fluid. Water can be used to wash some harmful agents from personnel and lessen the spread of these agents. Water is readily available in existing wet and dry sprinkler systems. Some systems, according to the present invention, use decontamination liquids other than, or in addition to, water. Alternative fluids can be introduced in place of; or added to, the existing sprinkler water supply when harmful agents are detected. In one system, sprinklers disperse water in normal operation but have special decontamination fluids feed into the sprinkler lines only when harmful agents are detected. This system avoids dispensing decontamination fluid for normal fire suppression. In some embodiments of this system, the initial liquid is water, followed by either the alternate decontamination fluid or a mixture of the alternate decontamination fluid and water. In some systems a solid or slurry is mixed with water to create the decontamination fluid.

Dry sprinkler systems exist in some buildings, having, typically, compressed air immediately behind the ceiling sprinkler heads. When the sprinkler head fusible element melts in response to heat, the compressed air escapes and the air pressure drops. The drop in air pressure can be sensed by the system, which can respond by flooding the sprinkler pipes with water, which can be dispersed through any open sprinkler heads. The present invention can be used in conjunction with dry sprinkler systems and can supply either liquid or gaseous decontamination fluid. For example, gaseous decontamination fluid can be fed into the sprinkler pipes in place of water when a particular harmful agent is detected. For example, liquid decontamination fluid other than water can be fed into the sprinkler pipes in place of water when a particular harmful agent is detected. In a hybrid system, gaseous decontamination fluid can be fed into a wet sprinkler system to force out the existing water and replace the water flow with flow of a gaseous substance. Such as hybrid system can be used to provide dispersion of a gaseous decontamination fluid through a wet sprinkler system. In one embodiment, the decontamination fluid to be dispersed can be selected at the time of detection, and can be determined based on the particular harmful agent detected.

Figure 2:
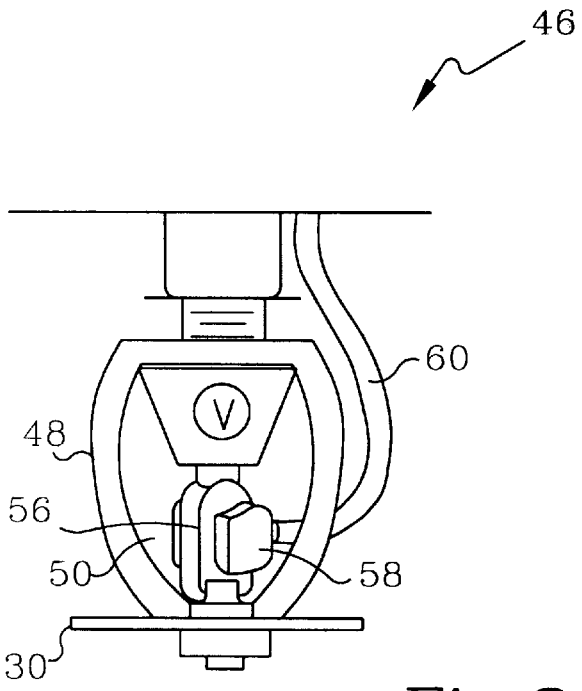
FIG. 2 is a side view of a sprinkler head having a temperature sensitive activating element and a severing heating element disposed near the temperature sensitive element.

Referring now to FIG. 2, a sprinkler head 46 is shown, including a support structure 48, sprayer or diffuser 30, and a temperature sensitive element 50 including a temperature sensitive joint 56. In FIG. 2, the valve actuator is illustrated by a heating severing element 58 disposed against or near temperature sensitive element 50. Heating element 58 is linked to a controller by a communication line 60. In one embodiment, severing element 58 includes a resistance wire wound around temperature sensitive element 50. When activated, heating element 50 can melt joint 56 and allow water to flow from sprinkler 46.

Figure 3:
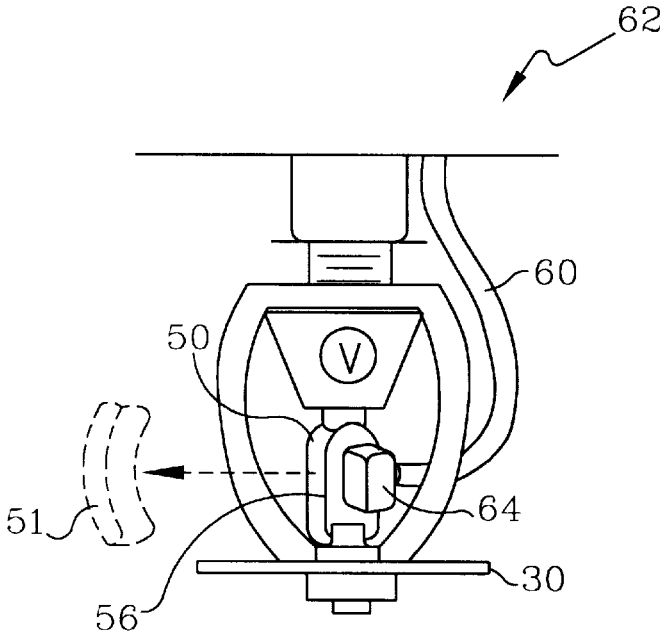
FIG. 3 is a side view of a sprinkler head having a temperature sensitive activated element and a severing explosive element or squib disposed near the temperature sensitive element.

Referring now to FIG. 3, another sprinkler head 62 is illustrated in which the valve actuator is a small explosive charge or squib 64 disposed near temperature sensitive element 50. When activated, squib 64 can break joint 56 or otherwise open the sprinkler to flow. Severed or dislodged element 50 is indicated at 51. In some embodiments, squib 64 takes the form of a small directed charge. On one embodiment, squib 64 requires less charge than a 0.22 caliber shell typically used in some nail guns or bolt drivers.

The use of replacement, remotely actuated elements in existing sprinkler heads or the use of severing elements disposed near existing sprinkler head elements may or may not arguably cause an existing fire control system to be out of compliance with local building codes. Even if this is the case, the fire control system retains its existing fire control capabilities and the exigencies of the circumstances may dwarf the building code concerns. In embodiments where extra sprinkler heads are added to serve a decontamination purpose, severing elements as illustrated in FIGS. 2 and 3 may also be used in conjunction with conventional fire control sprinklers. In these embodiments, the severing elements allow use of off-the-shelf sprinkler heads, which are readily available and which are relatively inconspicuous.

Numerous advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A decontamination system for responding to the detection of the presence of chemical or biological agents in a building having a sprinkler system for fire protection, the sprinkler system having a sprinkler head in fluid communication with a feeder pipe, the system comprising:

means for opening said sprinkler head to release a fire suppressant material in response to a fire indicator;

means for opening said sprinkler head to release a decontaminations material different from the fire suppressant material in response to a chemical or biological agent detection signal;

fire detecting means for detecting the presence of fire in the building and for providing the fire indicator, chemical or biological detecting means for detecting the presence of a chemical or biological agent that is not otherwise given off by a conventional fire; and means for generating said chemical or biological agent detection signal responsive to said chemical or biological detecting means.

2. A system as recited in claim 1, wherein said feeder pipe is adapted and configured to deliver water in response to the fire indicator, and is adapted and configured to deliver decontaminating material in response to the chemical or biological agent signal, wherein the decontaminating material comprises non-aqueous material, or mixtures of non-aqueous decontaminating material and water.

3. A system as recited in claim 2, where said sprinkler head is positioned over a building hallway.

4. A system as recited in claim 2, wherein said chemical or biological detecting means includes a chemical sensor adapted and configured to detect nerve agents, biological agents, or phosgene, said means for generating said chemical or biological agent detection signal includes electronic circuitry, and said means for opening said sprinkler head includes one or more valves.

5. A system as recited in claim 1, wherein said feeder pipe delivers a gas.

6. A decontamination system for responding To the detection of the presence of chemical or biological agents in a building having a sprinkler system for fire protection, the sprinkler system having u plurality of springier heads in fluid communication with a number of feeder pipes, the system comprising:

a fire detector for detecting the presence of fire in the building;

a valve local to at least one of the sprinkler heads for allowing flow from a feeder pipe and through said at least one sprinkler head, said valve responsive to said fire detector;

said valve also allowing flow from the feeder pipe and through said at least one sprinkler head in response to a chemical or biological agent detection signal;

a chemical or biological agent detector for detecting a nerve agent, a biological agent, or phosgene; and circuitry for generating said chemical or biological agent detection signal responsive to said chemical or biological agent detector.

7. A system as recited in claim 6, wherein said at least one sprinkler head includes a temperature sensitive element that melts at a known temperature and said system includes a heating element disposed near said element for melting said element in response to said chemical or biological agent detection signal.

8. A system as recited in claim 6, wherein said at least one sprinkler head includes a temperature sensitive element that melts at a known temperature and said system includes an explosive element disposed near said element for severing said element in response to said chemical or biological agent detection signal.

9. A decontamination system for responding to The detection of the presence of chemical or biological agents in a building having a sprinkler system for fire protection, the sprinkler system having a plurality of sprinkler beads in fluid communication with a number of feeder pipes, the system comprising;

fire detecting means for detecting the presence of fire in the building;

chemical or biological detecting means for detecting the presence of a nerve agent, a biological agent, or phosgene in the building, and for providing a chemical or biological agent detection signal;

means for opening one or more of said sprinkler heads in response to the fire detecting means;

means for delivering water to one or more of said feeder pipes in response to the fire detecting means;

means for opening one or more of said sprinkler heads in response to the chemical or biological agent detection signal; and means for delivering a chemical or biological agent decontamination fluid to one or more of said feeder pipes in response to the chemical or biological agent detection signal.

10. The system claim 9 wherein the decontamination fluid is water.

11. The system claim 9 wherein the decontamination fluid is not water.

12. The system of claim 11 wherein a source of a number of decontamination fluids is in communication with the means for delivering the decontamination fluid to one or more of the feeder pipes which are in fluid communication with one or more sprinkler head, and the particular decontamination fluid to be dispersed is selected by a controller at the time of detection.

* * * * *